United States Patent [19]

Murakami et al.

[11] Patent Number: 4,840,817

[45] Date of Patent: Jun. 20, 1989

[54] METHOD FOR TREATMENT OF FIBROUS MATERIALS

[75] Inventors: Shuichi Murakami; Yasunao Shimano, both of Ishikawa, Japan

[73] Assignee: Komatsu Seiren Co., Ltd., Ishikawa, Japan

[21] Appl. No.: 159,094

[22] Filed: Feb. 23, 1988

[51] Int. Cl.[4] ..... B05D 3/02

[52] U.S. Cl. ..... 427/45.1; 427/377; 427/393.3; 427/394; 427/396

[58] Field of Search ..... 427/45.1, 393.3, 377, 427/394, 396

[56] References Cited

U.S. PATENT DOCUMENTS

| | | | |
|---|---|---|---|
| 3,310,419 | 3/1967 | Wagner | 427/393.3 |
| 3,666,544 | 5/1972 | Kuechler | 427/377 |
| 3,775,155 | 11/1973 | Eggenweiler et al. | 427/377 |
| 3,859,124 | 1/1975 | Thompson | 427/377 |
| 4,076,540 | 2/1978 | Stossel | 427/288 |
| 4,154,878 | 5/1979 | Baitinger et al. | 427/365 |
| 4,168,347 | 9/1979 | Spicuzza et al. | 427/45.1 |

*Primary Examiner*—Janyce Bell

*Attorney, Agent, or Firm*—Armstrong, Nikaido Marmelstein & Kubovcik

[57] ABSTRACT

A fabrous material is impregnated with a treating agent comprising (1) a tetrakishydroxymethyl phosphonium compound or an ammonium condensate of a tetrakishydroxymethyl phosphonium compound, (2) methylolmelamine and (3) urea, thiourea or a guamidine salt, and the fabric is heated with high-pressure steam or subjected to a microwave heat treatment in the pressure of water vapor. A high and durable flame retardancy can be imparted to the fibrous material by this treatment. Especially good results are obtained when a fibrous material composed of a mixture of a polyester fiber and a cellulose fiber is treated according to this method.

9 Claims, 20 Drawing Sheets

METHOD FOR TREATMENT OF FIBROUS MATERIALS

BACKGROUND OF THE INVENTION (1) Field of the Invention

The present invention relates to a method for the treatment of fibrous materials. More particularly, the present invention relates to a method for the treatment of fibrous materials for imparting a durable flame retardancy to a fibrous material composed of a cellulose fiber or a mixture of a cellulose fiber and other fibers.

(2) Description of the Related Art

As the conventional means for imparting a durable flame retardancy to a fibrous material composed solely of a cellulose fiber, there can be mentioned a Proban method (Albright & Willson Co.) in which the fibrous material is ammonia-cured with a tetrakishydroxymethyl sulfonium salt-urea precondensate, a method in which the fibrous material is treated by heat-reacting N-hydroxymethyl-3-dimethylphosphonopropionamide (Pyorovatex CP supplied by Ciba-Geigy) with a methylolmelamine type compound, and a method in which the fibrous material is treated by polymerizing a vinyl phosphonate oligomer (Fyrol 76 supplied by Stauffer Chemical Co.) and N-methylolacrylamide in the presence of a catalyst.

As the conventional means for imparting a durable flame retardancy to a fibrous material composed of a polyester fiber, there can be mentioned an exhaustion bath method in which hexabromocyclododecane is absorbed in the fibrous material by using an aqueous dispersion thereof, a method in which hexabromocyclododecane is diffused in the interior of the fiber according to the thermosol process, an exhaustion bath method using a dispersion of tris-dichloropropyl phosphate, a method in which tris-dichloropropyl phosphate is fixed to the fibrous material according to the thermosol process, and a method in which a phosphorus-containing cyclic compound is fixed to the fibrous material according to the thermosol process using an aqueous solution thereof.

These flame-proofing methods are effective for fibers composed solely of a cellulose or polyester, but are not effective for a mixed fibrous material of a polyester fiber and a cellulose fiber. Especially in the case of a fiberous material comprising a polyester fiber and a cellulose fiber at a mixing ratio of from 70/30 to 30/70, it is difficult to obtain a product having a practically satisfactory flame retardancy, touch, and physical properties.

As a method for imparting a flame retardancy to a fibrous material composed of a mixture of a polyester fiber and cotton, there is known a method in which hexabromocyclododecane, antimony trioxide and an acrylic latex are used in combination. However, this method is defective in that the touch of the processed product is hard and the hue of the dyed product is whitened.

Moreover, a method is proposed in which a fiber is impregnated with a composition comprising a tetrakishydroxymethyl sulfonium salt-ammonia condensate (THPN), methylolmelamine and urea, dried and heat-cured [American Dyestuff Reporter 74, No. 1, 35–40 (1985)]. The treated product obtained according to this method has a relatively high flame retardancy, but the method is defective in that the given flame retardancy cannot resist a 50-times repetition of washing, which is ordinarily required in the field of clothing, and the hardening of the touch is extreme.

It is considered that it is difficult to impart a durable flame retardancy to a fibrous material composed of a mixture of a polyester fiber and a cellulose fiber because, in the polyester fiber, the flame retardancy is exerted by a promotion of melting while the flame retardancy is exerted by a promotion of carbonization in the cellulose fiber, fusion falling of the polyester is inhibited in the presence of the cellulose because of this difference of the combustion behavior, and thus the self-extinguishing property is reduced.

SUMMARY OF THE INVENTION

Research was made with a view to overcoming the foregoing difficulties of the conventional methods and providing a method capable of imparting a durable flame retardancy to a fibrous material, and as a result, the present invention was completed.

More specifically, in accordance with the present invention, there is provided a method for the treatment of fibrous material, which method comprises, impregnating a fibrous material with a treating agent comprising (1) a tetrakishydroxymethyl phosphonium compound or an ammonium condensate of a tetrakishydroxymethyl phosphonium compound, (2) methylolmelamine and (3) urea, thiourea or a guanidine salt, and heating the fibrous material with high-pressure steam or subjecting the fibrous material to a microwave heat treatment in the presence of water vapor.

According to the method of the present invention, a high flame retardancy can be imparted to a fibrous material, and even a fibrous material composed of a mixture of a polyester fiber and a cellulose fiber can be rendered flame-retardant, though this is impossible according to the conventional methods. Furthermore, the durability of the given flame retardancy is practically satisfactory and the touch of the processed fibrous material is excellent.

DESCRIPTION OF THE PREFERRED EMBODIMENTS

In the fibrous material of a mixture of a polyester fiber and a cellulose fiber, referred to in the present invention, the cellulose fiber is cotton, rayon, flax or the like, and the mixing ratio of the cellulose fiber is 20 to 100%.

By the term "mixture" is meant mix spinning, mix weaving, mix twisting, mix knitting or the like, and the fibrous material may be in the form of a yarn, a web, a cloth, a woven fabric, a knitted fabric, a nonwoven fabric or the like.

The fibrous material is subjected to the flameproofing treatment of the present invention after scouring and bleaching treatments or after dyeing with a durene dye.

The tetrakishydroxymethyl phosphonium compound used as the treating agent in the present invention is represented by the following general formula:

$$(HOCH_2)_4P^+X^-$$

wherein X stands for Cl, $1/2SO_4$ or OH.

The compounds in which X stands for Cl, $1/2SO_4$ and OH are abbreviated as THPC, THPS and THPOH, respectively.

The ammonium condensate of the tetrakishydroxymethyl phosphonium compound (THPN) is represented by the following structural formula:

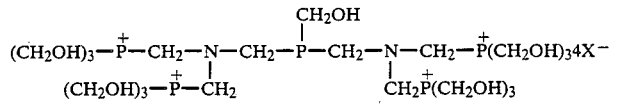

wherein X stands for Cl, $1/2SO_4$ or OH.

Commercially available THPS or THPC having a solid content of about 80% can be used in the present invention, and THPN can be easily obtained by reacting the tetrakishydroxymethyl phosphonium compound with 1/2.5 mole of ammonia.

As the methylolmelamine (2), there can be mentioned hexamethylolmelamine and trimethylolmelamine. As the commercially available product, there can be mentioned Sumitex Resin M-6, M-3 and MC supplied by Sumitomo Kagaku Kogyo. As the catalyst for the methylolmelamine, there can be mentioned salts of organic acids such as malic acid and tartaric acid and inorganic acids such as sulfuric acid, persulfuric acid, and nitric acid, and strong acid salts of organic amines.

A commercially available industrial powdery product can be directly used as urea or thiourea (3). As the quanidine salt, there can be mentioned guanidine phosphate and guanidine hydrochloride. A commercial available industrial product can be directly used.

Each of the components (1), (2) and (3) is ordinarily applied to the fibrous material in the form of an aqueous solution. The concentration of the component (1) is 20 to 80%, the concentration of the component (2) is 2 to 30%, and the concentration of the component (3) is 2 to 30%. The pad mangle squeezing method is generally used for applying the treating agent to the fibrous material. Furthermore, the spray method, the kiss roll method, and the bubble processing method can be adopted.

The treatment of the present invention is effected by the microwave irradiation in the presence of water.

This treatment is advantageous over the ordinarly dry heat-curing method in that the migration of the flame retardant is reduced and the fibrous material is uniformly heated from the inner deep portion, the distribution of the flame retardant with respect to the section of the fibrous material is uniform, an since a highly crosslinked polymer is formed, a flame-retardant product having an excellent washing resistance can be obtained.

An electronic reactor Apollotex supplied by Ichikin Kogyo is preferably used for the microwave irradiation treatment.

The microwave irradiation may be carried out at frequency of 2450 MHz and an output of 0.2 to 20 kW, preferably 2 to 10 kW, for 10 seconds to 60 minutes, preferably 10 to 30 minutes, in the presence of steam under a direct stream pressure of 0.1 to 3 g/cm$^2$. If steam is not present, a uniform irradiation with microwaves is not obtained, and a migration of the treating agent to the surface of the fibrous material readily occurs.

Alternatively, the treatment of the present invention is effected by the heating with high-pressure steam. This treatment may be carried out with saturated steam under a pressure of 0.1 to 3 kg/cm$^2$, preferably 0.5 to 2.5 kg/cm$^2$, for 10 to 120 minutes, preferably 30 to 90 minutes.

Then, a soaping treatment is carried out for removing the unfixed treating agent. Preferably, the soaping treatment is conducted in warm water or an aqueous solution of soda ash at 80° to 100° C. for 5 to 30 minutes. In view of the crumpling effect, a liquid flow dyeing machine is preferably used for the soaping treatment, but a wince or other ordinarily used machine can be used and the kind of the machine is not particularly critical.

Preferably, the sticking ratio of the flame retardant to the soaped and dried fibrous material is 5 to 45% by weight, especially 10 to 30% by weight.

The flame retardancy of the so-obtained fibrous material is much higher than those of the conventional flame-retardant fibrous materials, and the fibrous material treated according to the method of the present invention has an excellent washing resistance and cleaning resistance. Furthermore, hardening of the touch is reduced and reduction of the tear strength is controlled.

These treatment effects are obtained because the flame retardant composed of the three components is highly crosslinked by the microwave irradiation and is uniformly distributed in the fibrous material.

The present invention will now be described in detail with reference to the following examples, that by no means limit the scope of the invention.

In the examples, the physical properties were evaluated according to the following methods.

Water Washing

A powdery washing soap (first class of JIS K-3303) was used in an amount of 1 g per liter or water, water maintained at 60° C. was supplied, and a detergent was added. Then, the sample was thrown into the solution and washed for 15 minutes with the solution at 60° C. The solution was then discharged and the sample rinsed three times with water at 40° C. for 5 minutes. Removal of the water and dehydration were conducted for 2 minutes. The foregoing treatments were regarded as one cycle, and the sample was treated for 5 cycles, 30 cycles or 50 cycles.

Dry Cleaning

The test was carried out according to the cleaning method specified in Notice No. 1 of the Fire Defence Agency, but prior to the dry cleaning treatment, the sample was subjected to a warm water treatment at 40° C. for 30 minutes and then dried according to customary procedures.

Flame Retardancy Test

1. Vertical Methane Burner Method (test for clothes)

Size of sample: 89 mm×254 mm

Number of sample: 5

Adjustment of state of sample:

The sample was dried in a thermostat drier at 50°±20° C. for 24 hours and was then dried in a desiccator charged with silica gel for more than 2 hours.

(a) The flame length was adjusted to 38 mm measured vertically from the highest point of the burner, and it was confirmed that the flame was stable. The burner was moved and the sample placed in contact with the flame for 3.0±0.2 seconds. The flame of the burner was separated from the sample, and on a sample-supporting flame, the combustion state and the flame igniting property were checked.

(b) With respect to five samples of each fabric, the average carbonization length must be smaller than 178 mm and the maximum carbonization length must be smaller than 254 mm, and the fabric must not have a flame igniting property.

2. 45° Methanamine Method (test for bedclothes)

Size of sample: 35 cm×25 cm

Number of sample: 3

Adjustment of state of sample:

The sample was dried in a thermostat drier at 50°±2° C. for 24 hours and then dried in a desiccator charged with silica gel for more than 2 hours.

(a) The sample was placed on a metal net of a sample-supporting frame and tightly fixed thereto, and methanamine (Tablet No. 1588 Methanamine supplied by Eli Lilly & Company) was placed at a position 5 cm above th center of the lower side of the interior of the sample-supporting frame so that the methanamine was not easily moved.

(b) Ignition was effected by a match, and after the ignition, a glass window of a combustion test box was promptly closed and the sample was allowed to stand until the combustion ended.

(c) With respect to three samples, the maximum carbonization length in the longitudinal direction in the carbonized portion must be smaller than 70 mm and the average carbonization length must be smaller than 50 mm.

EXAMPLE 1 AND COMPARATIVE EXAMPLE 1

A polyester/cotton (65/35) mix-spun plain weave fabric having a base weight of 200 g was inpregnated with a aqueous solution containing 30% of THPS (solid content=80%), 9% of Sumitex Resin M-6, 1% of ammonium persulfate and 7% of urea, and the fabric was squeezed by a mangle so that the impregnation ration was 75%. Then, reaction was carried out by using an electronic reactor (Apollotex supplied by Ichikin Kogyo) under the conditions of a microwave output of 7.0 kW, a reaction time of 30 minutes, a direct steam pressure of 0.7 kg/cm$^2$ and a winding speed of 10 m/min.

The treated fabric was then washed with warm water at 80° C. for 30 minutes in a liquid flow dyeing machine.

For comparison, the fabric was impregnated with the above-mentioned flame retardant solution, dried at 120° C., cured at 180° C. for 2 minutes by a tenter, subjected to the soaping treatment and dried (Comparative Example 1).

The flame retardant sticking ratio and flame retardancy were evaluated. The results are shown in Table 1.

TABLE 1

| | Example 1 | Comparative Example 1 |
|---|---|---|
| Flame retardant sticking ratio (%) | | |
| as-prepared | 25 | 22 |
| after washing 30 times | 22 | 15 |
| after washing 50 times | 20 | 10 |
| Flame retardancy (vertical methane burner method) (carbonization length, mm) | | |
| as-prepared | 28 | 45 |
| after washing 30 times | 42 | wholly burnt |
| after washing 50 times | | wholly burnt |

It is seen that, in the fabric treated according to the present invention, removal of the flame retardant by washing controlled and a sufficient flame retardancy was maintained even after washing was conducted 50 times, and the comparative fabric showed a flame retardancy in the as-prepared state but the flame retardancy could not resist washing.

EXAMPLE 2 AND COMPARATIVE EXAMPLE 2

A plain weave fabric composed solely of cotton and having a base weight of 100 g was impregnated with an aqueous solution containing 40% of THPS (solid content=80%), 12% of Sumitex Resin M-6, 1% of diammonium phosphate and 10% of urea. The fabric was squeezed by a mangle so that the impregnation ratio was 100%, and reaction was carried out by using Apollotex (supplied by Ichikin Kogyo) under the conditions of a microwave output of 7.0 kW, a reaction time of 30 minutes, a direct steam pressure of 0.7 kg/cm$^2$, and a winding speed of 10 m/min.

The fabric was washed with water at 80° C. for 30 minutes in a liquid flow dyeing machine and then dried.

For fabric wave washed with water at 80° C. for 40 minutes in a liquid flow dyeing machine and then dried.

For comparison, the fabric impregnated with the above-mentioned flame retardant solution was preliminarily dired at 120° C., heat-treated at 180° C. for 3 minutes by a loop type drier, soaped and dried (Comparative Example 2).

The flame retardant sticking ratio and flame retardancy were evaluated. The results are shown in Table 2.

TABLE 2

| | Example 2 | Comparative Example 2 |
|---|---|---|
| Flame retardant sticking ratio (%) | | |
| as-prepared | 26 | 25 |
| after washing 30 times | 24 | 15 |
| after washing 50 times | 22 | 13 |
| Flame retardancy (vertical methane burner method) (carbonization length, mm) | | |
| as-prepared | 20 | 28 |
| after washing 30 times | 23 | wholly burnt |
| after washing 50 times | 26 | wholly burnt |

It is seen that in the fabric treated according to the present invention, removal of the flame retardant by washing was controlled and the flame retardancy was durable. The flame retardancy of the comparative fabric was sufficient in the as-prepared state by the flame retardant was readily removed by washing and the flame retardancy was not durable.

EXAMPLE 3

A polyester/rayon (50/50) mix-spun twill fabric having a base weight of 150 g was impregnated with an aqueous solution containing 35% of THPN (solid content=80%), 10% of Sumitex Resin M-6, 1% of diammonium phosphate and 12% of urea. The fabric was squeezed by a mangle so that the impregnation ratio was 80%, and reaction was carried out under the conditions of a microwave output of 5 kW, a reaction time of 40 minutes, a direct steam pressure of 0.5 kg/cm$^2$, and a winding speed of 8 m/min.

The fabric was washed with warm water at 90° C. for 40 minutes by a liquid flow dyeing machine and was then dired.

The sticking ratio of the flame retardant to the fabric was 20%.

The flame retardancy was evaluated. The results are shown in Table 3.

TABLE 3

| | Flame Retardancy (carbonization length, mm) | |
|---|---|---|
| | 45° C. Methenamine Method | Vertical Methane Bruner Method |
| as-prepared | 28 | 27 |
| washing after 30 times | 30 | 40 |
| washing after 50 times | 31 | 45 |

It is seen that the treated fabric had an excellent flame retardancy and had a practically sufficient durability as a bed sheet or clothing.

EXAMPLE 4

A twill fabric composed of polyester/cotton (65/35) having a base weight of 250 g was scoured, bleached, immersed in a dyeing solution containing 2.5 g/l of Resolin Blue FBL (dispersed dye supplied by Bayer), 5.5 g/l of Mikethren Blue GCD (durene dye supplied by Mitsui Kagaku) and 1.0 g/l of sodium alginate and squeezed at an impregnation ratio of 80% by a mangle. The fabric was then dried at 120° C. for 5 minutes and heat-set at 200° C. for 1 minute, immersed in a treating solution containing 60 g/l or hydrosulfite, 60 g/l of caustic soda and 40 g of sodium sulfate, squeezed at an impregnation ratio of 80% by a mangle, and treated in saturated stream for 1 minute. Then, the fabric was oxidized at room temperature for minute in a treating solution containing 10 g/l of 35% hydrogen peroxide. Finally, the fabric was subjected to the soaping treatment at 100° C. for 5 minutes in a soaping solution containing 2 g/l of a soap (Marcel Soap), 2 g/l of a nonionic penetrant, and 1 g/l of sodium carbonate and dried at 120° C.

The dyed fabric was immersed in a flame retardant solution containing 35% of THPN (solid content=35%), 12% of Sumitex Resin M-6, 0.5% of tartaric acid and 9% of thiourea. The fabric was squeezed at an impregnation ratio of 80% by a mangle. By using Apollotex (supplied by Ichikin Kogyo), reaction was carried out under the conditions of a microwave output of 6.0 kW, a reaction time of 40 minutes, a direct steam pressure of 0.7 kg/cm$^2$, and a winding speed of 8 m/min. The fabric was subjected to a soaping treatment at 100° C. for 40 minutes in a liquid slow dyeing machine and then dried.

The sticking ratio of the flame retardant to the fabric was 26%. When the flame retardancy of the fabric was measured in the as-prepared state, after washing 50 times and after dry cleaning 5 times according to the vertical methane burner method, it was found that the carbonization lengths were 20 mm, 44 mm and 23 mm, respectively. It was confirmed that the fabric met the flame retardancy standard for clothes.

EXAMPLE 5

The dyed polyester/cotton mixed fabric used in Example 4 was impregnated with a flame retardant solution containing 35% of THPS (solid content=80%), 10% of Sumitex M-6, 0.5% of potassium persulfate and 10% of guanidine hydrochloride, and squeezed at an impregnation ratio of 80% by a mangle. By using Apollotex (supplied by Ichikin Kogyo), reaction was carried out under the conditions of a microwave output of 6.0 kW, a reaction time of 40 minutes, a direct stream pressure of 0.7 kg/cm$^2$, and a winding speed of 20 m/min. the fabric was subjected to a soaping treatment in a soaping solution containing 5 g/l of sodium carbonate at 80° C. for 30 minutes in a liquid flow dyeing machine and washed with warm water at 90° C. for 60 minutes. The fabric was dried at 120° C. and heat-set at 180° C. The sticking ratio of the flame retardant to the fabric was 22%. When the flame retardancy of the fabric was measured in the as-prepared state and after washing 50 times according to the vertical methane burner method, it was found that the carbonization lengths were 38 mm and 69 mm, respectively, and it was confimed that the fabric met the flame retardancy standard for clothes.

EXAMPLE 6

A mixed fabric (union cloth) of polyester/cotton (65/35) having a base weight of 100 g/m$^2$ singed, desized, scoured, bleached, heat set and dyed, according to a conventional method, and then, was subjected to fixation using an aqueous solution containing 50 parts by weight of THPS (solid content=80%), 10 parts by weight of urea, 10 parts by weight of Sumitex Resin M-3, 1 part by weight of diammonium phosphate, 0.1 part by weight of Emulgene 909 (surfactant) and 28.9 parts by weight of water, on a high pressure steamer, under a steam pressure of 1.7 kg/cm$^2$ for 60 minutes. The fabric was then soaped and dried.

The sticking amount of the flame retardant to the fabric was 25%.

When the flame retardancy of the fabric was measured in the as-prepared state, after washing 30 times and after washing 50 times according to the vertical methane burner method, it was confirmed that the carbonization lengths were 28 mm, 40 mm and 45 mm, respectively, and the fabric met the flame retardancy standard for clothes.

We claim:

1. A method for the treatment of fibrous materials, which comprises (A) impregnating a fibrous material with a treating agent comprising (1) a tetrakishydroxymethyl phosphonium compound or an ammonium condensate of tetrakishydroxymethyl phosphonium compound, in a concentration in the range of 20 to 80%, (2) methylolmelamine in a concentration of 2 to 30% and (3) urea, thiourea or a guanidine salt, in a concentration of 2 to 30%, (B) heating the fibrous material with high-pressure steam under a pressure in the range of 0.1 to 3 kg/cm$^2$ or subjecting the fibrous material to a microwave heat treatment in the presence of water vapor, and (C) drying the fibrous material.

2. A method as set forth in claim 1, wherein the fibrous material is a mixture of a polyester fiber and a cellulose fiber.

3. A method as set forth in claim 1, wherein the tetrakishydroxymethyl phosphonium compound is represented by the following formula;

$$(HOCH_2)_4P^+X^-$$

wherein X stands for Cl, $1/2SO_4$ or OH.

4. A method as set forth in claim 1, wherein the ammonium condensate of a tetrakishydroxymethyl phosphonium compound is represented by the following formula;

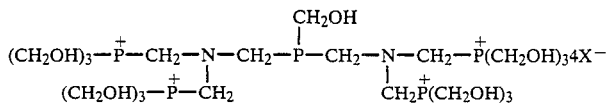

wherein X stands for Cl, $1/2SO_4$ or OH.

5. A method as set forth in claim 1, wherein the methylolmelamine is selected from the group consisting of hexamethylolmelamine and trimethylolmelamine.

6. A method as set forth in claim 1, wherein the guanidine salt is selected from the group consisting of guanidine phosphate and guanidine hdyrochloride.

7. A method as set forth in claim 1, wherein the treating agent is applied as an aqueous solution containing the compounds (1), (2) and (3).

8. A method as set forth in claim 1, wherein the microwave irradiation is carried out at a frequency of 2450 MHz and an output of 0.2 to 20 kW for 10 to 60 minutes, in the presence of steam under a direct steam pressure of 0.1 to 3 $kg/cm^2$.

9. A method as set forth in claim 1, wherein the heating with high-pressure steam is carried out with saturated steam for 10 to 60 minutes.

* * * * *

UNITED STATES PATENT AND TRADEMARK OFFICE

CERTIFICATE OF CORRECTION

PATENT NO. : 4,840,817

DATED : June 20, 1989

INVENTOR(S) : MURAKAMI et al

It is certified that error appears in the above-identified patent and that said Letters Patent is hereby corrected as shown below:

On the cover page, after Item [22] insert the following:

--[30] Foreign Application Priority Data

Mar. 24, 1987 [JP] Japan ..... 62-68080
Apr. 22, 1987 [JP] Japan ..... 62-97574--.

Signed and Sealed this

Seventeenth Day of April, 1990

*Attest:*

HARRY F. MANBECK, JR.

*Attesting Officer*

*Commissioner of Patents and Trademarks*